US012653252B2

(12) United States Patent
Macchione

(10) Patent No.: US 12,653,252 B2
(45) Date of Patent: Jun. 16, 2026

(54) FACE MASK

(71) Applicant: Pilar Macchione, New York, NY (US)

(72) Inventor: Pilar Macchione, New York, NY (US)

(73) Assignee: Pilar Macchione, New York, NY (US)

( * ) Notice: Subject to any disclaimer, the term of this patent is extended or adjusted under 35 U.S.C. 154(b) by 580 days.

(21) Appl. No.: 17/377,077

(22) Filed: Jul. 15, 2021

(65) Prior Publication Data

US 2022/0022572 A1 Jan. 27, 2022

Related U.S. Application Data

(60) Provisional application No. 63/103,252, filed on Jul. 24, 2020.

(51) Int. Cl.
*A41D 13/11* (2006.01)

(52) U.S. Cl.
CPC ..... *A41D 13/113* (2013.01); *A41D 13/1161* (2013.01)

(58) Field of Classification Search
CPC ..... A41D 13/11–1192; A62B 23/02–025
See application file for complete search history.

(56) References Cited

U.S. PATENT DOCUMENTS

| | | | | | |
|---|---|---|---|---|---|
| 2,728,339 | A * | 12/1955 | Elmhirst | A45D 44/22 | 2/206 |
| 6,123,077 | A * | 9/2000 | Bostock | A41D 13/11 | 128/206.19 |
| 2010/0218304 | A1* | 9/2010 | Tonegawa | A41D 13/113 | 2/206 |

FOREIGN PATENT DOCUMENTS

| | | | | |
|---|---|---|---|---|
| DE | 29806473 | U1 | * | 8/1998 |
| DE | 202020001709 | | * | 5/2020 |
| DE | 202020101979 | U1 | * | 5/2020 |
| KR | 200319381 | Y1 | * | 7/2003 |
| KR | 20090002495 | U | * | 3/2009 |
| KR | 20170093560 | | * | 8/2017 |
| KR | 101816198 | B1 | * | 1/2018 |
| KR | 101869654 | B1 | * | 6/2018 |
| KR | 20190125751 | A | * | 11/2019 |

OTHER PUBLICATIONS

KR 20090002495 U description translation access Feb. 27, 2024 (Year: 2024).*
KR20170093560 description translation access Feb. 28, 2024 (Year: 2024).*
KR-200319381-Y1 description translation access Feb. 28, 2024 (Year: 2024).*
KR-101869654-B1 description translation access Feb. 28, 2024 (Year: 2024).*

(Continued)

*Primary Examiner* — Brandy S Lee
*Assistant Examiner* — Kira B Daher
(74) *Attorney, Agent, or Firm* — Fish & Richardson P.C.

(57) ABSTRACT

A face mask of the present disclosure can create a space preventing a user's mouth from directly contacting the face mask. One example of the face mask includes a center sheet, two side sheets, and two fixing parts. The center sheet is a rectangular fabric. The two side sheets are coupled to long sides of the center sheet separately with a first edge of the side sheet. The fixing part is coupled to a second edge of the side sheet, and the second edge of the side sheet is opposite to the first edge of the side sheet.

9 Claims, 5 Drawing Sheets

(56) References Cited

OTHER PUBLICATIONS

KR 101816198 description translation accessed Aug. 8, 2024 (Year: 2018).*
KR20190125751 description translation accessed Aug. 8, 2024 (Year: 2019).*
DE-202020101979-U1 description (Year: 2020).*
DE-29806473-U1 description (Year: 1998).*

* cited by examiner

FACE MASK

CROSS-REFERENCE TO RELATED APPLICATIONS

This application claims priority to U.S. Provisional Application Ser. No. 63/103,252 filed on Jul. 24, 2020, the entire contents of which are herein incorporated by reference.

TECHNICAL FIELD

The present disclosure relates to a face mask with a breathable space.

BACKGROUND

People today wear face masks for many purposes. For example, wearing a face mask is mandatory to comply with pandemic protocols to mitigate the airborne transmission of viruses. However, wearing existing face masks might cause uncomfortable feelings. Furthermore, a contamination to the existing face masks could easily happen because of a direct contact by saliva or makeup.

SUMMARY

Based on the previous background, the present specification provides a face mask, including: a center sheet, two side sheets, and two fixing parts. The center sheet is a rectangular fabric. The two side sheets are coupled to long sides of the center sheet separately with a first edge of the side sheet. The fixing part is coupled to a second edge of the side sheet, and the second edge of the side sheet is opposite to the first edge of the side sheet.

In another illustrated implementation, the center sheet is curvy along a longitudinal axis of the center sheet.

In another illustrated implementation, the second edge of the side sheet comprises at least one dart.

In another illustrated implementation, the face mask further comprises a back sheet which is shaped corresponding to a shape of the center sheet coupled with the two side sheets.

In another illustrated implementation, the back sheet comprises an opening which forms a pocket between the center sheet, the two side sheets, and the back sheet.

In another illustrated implementation, the back sheet comprises at least two darts.

In another illustrated implementation, the fixing part is a strap which is coupled to two endpoints of the second edge of the side sheet to form a loop.

In another illustrated implementation, the strap comprises a toggle which adjusts a length of the strap.

In another illustrated implementation, the face mask further comprises a back center sheet and two back side sheets. The back center sheet is shaped corresponding to the center sheet and is coupled to the center sheet. The two back side sheets are shaped corresponding to the two side sheets, and the two back side sheets are coupled to the back center sheet, the center sheet, and the two side sheets to form a two-layered face mask.

In another illustrated implementation, the back center sheet is curvy along a longitudinal axis of the back center sheet.

In another illustrated implementation, at least one of the back side sheets comprises an opening which forms a pocket between the center sheet, the two side sheets, the back center sheet, and the two back side sheets.

In another illustrated implementation, at least one of the back side sheet comprises at least one dart.

DESCRIPTION OF DRAWINGS

Like reference numbers and designations in the various drawings indicate like elements.

DETAILED DESCRIPTION

This specification describes a face mask having a design that ensures an appropriate space between an inner surface of the face mask and the user's mouth, such that the user may breathe and talk comfortably through the face mask without the mouth making direct contact to the face mask. Furthermore, a contamination to the face mask can be avoided by the space between the face mask and the user's mouth. The face mask with a breathable space will be described in greater detail below, with reference to FIGS. 1, 2 and 3A to 3D.

Figure 1:
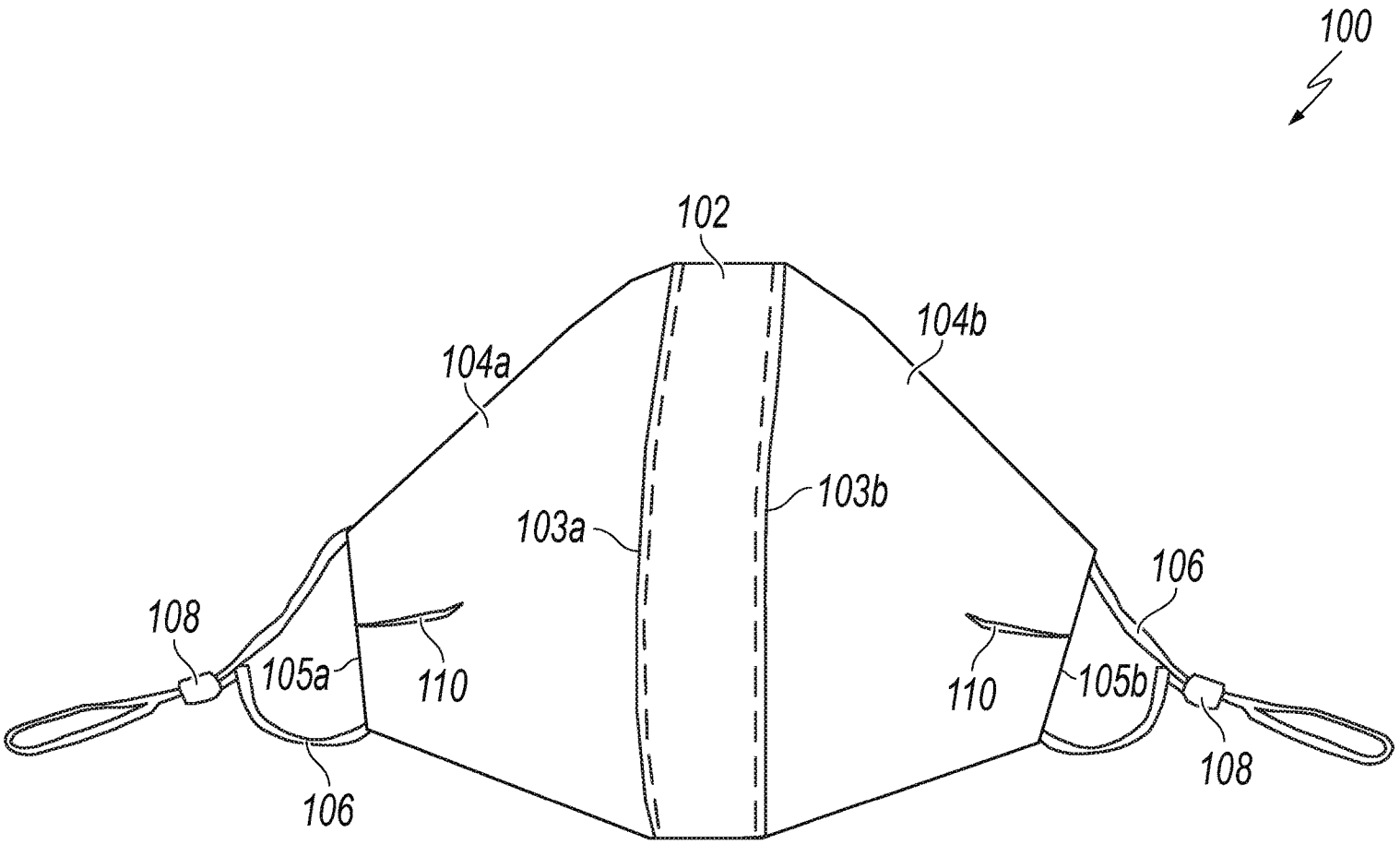
FIG. 1 is a diagram of an example face mask, according to an implementation.

FIG. 1 illustrates an example face mask 100 having a breathable space, according to an implementation. The face mask 100 comprises a center sheet 102, two side sheets 104*a*, 104*b*, and two fixing parts 106. In this specification, the term sheet refers to a contiguous fabric region having one or more layers that can be stitched to other sheets. In other words, a sheet need not have only a single layer of fabric.

The center sheet 102 is a stripe-like fabric. In one embodiment, the center sheet 102 is attached with the two side sheets 104*a*, 104*b* vertically. The center sheet 102 may be a structure or comprise a structure which is a rigid or semi-rigid to support the center sheet 102. In one embodiment, the center sheet 102 is a rectangular fabric which comprises two opposite long sides and two opposite short sides. In one embodiment, a width of the short side of the center sheet 102 may be one inch. In one embodiment, a length of the long side of the center sheet 102 may be six inches. The center sheet 102 is curved along a longitudinal axis. For example, the curved shape of the center sheet 102 may be determined based on a user's face profile, in order to create an appropriate room to separate the user's nose and month from the face mask 100. In one embodiment, a length of the long side of the center sheet 102 can be determined based on a user's face profile, e.g., a length from the user's nose to the user's chin, to ensure an efficient coverage of the user's nose and mouth.

The two side sheets 104*a*, 104*b* are two sheets which mirror each other. For example, the side sheet 104*a* includes a relatively flat region of fabric which comprises a first edge 103*a* and a second edge 105*a*. Likewise, the side sheet 104*b* comprises a first edge 103*b* and a second edge 105*b*. The first edge 103*a*, 103*b* is opposite to the second edge 105*a*, 105*b*. A length of the first edge 103*a*, 103*b* of the side sheet 104*a*, 104*b* is corresponding to a length of the long side of the center sheet 102, and the first edge 103*a*, 103*b* of the side sheet 104*a*, 104*b* is coupled to the long side of the center sheet 102. In one embodiment, the first edge 103*a*, 103*b* of the side sheet 104*a*, 104*b* is sewed to the edge of the long side of the center sheet 102. In one embodiment, a shape of the side sheet 104 may be similar to a shape of the user's cheek. The side sheet 104*a*, 104*b* comprises at least one dart 110 at the second edge 105*a*, 105*b*, so that the shape of the side sheet 104*a*, 104*b* may fit the user's cheek better. The two side sheets 104*a*, 104*b* are coupled to the two long sides of the center sheet 102 separately to form a body of the face mask 100.

The fixing part 106 is coupled to the second edge 105*a*, 105*b* of the side sheet 104*a*, 104*b* individually to secure the body of the face mask 100 to cover the user's face. In one embodiment, the fixing part 106 may be an ear loop, a head tie, a strap, and any suitable element which can secure the body of the face mask 100 to the user's head. In one embodiment, the fixing part 106 is an elastic strap. When the fixing part 106 is an ear loop or an elastic strap, the fixing part 106 can be coupled to two endpoints of the second edge 105*a*, 105*b* of the side sheet 104*a*, 104*b* to form a loop, such that the user can wear the face mask by placing the fixing parts 106 on his/her ears. Furthermore, the fixing part 106 may comprise a toggle 108 which can adjust a length of the fixing part 106. For example, when the fixing part 106 is a strap, the toggle 108 can be attached to the middle of the strap, so a position of the toggle 108 on the strap can be adjusted to reach an appropriate length to fit the user better.

In one embodiment, the face mask 100 further comprises a back sheet (not shown) to form a two-layered face mask. The back sheet is shaped corresponding to a shape of the body of the face mask 100, e.g., the size of the center sheet 102 coupled with the two side sheets 104*a*, 104*b*, and the back sheet is coupled to the center sheet 102 and the two side sheets 104*a*, 104*b*. For example, the back sheet is sewed together with the center sheet 102 and the two side sheets 104*a*, 104*b* along the edge of the back sheet. In one embodiment, the back sheet may comprise an opening to create a pocket within the face mask 100, so that the user can add a different filter into the face mask 100 based on his/her needs.

Figure 2:
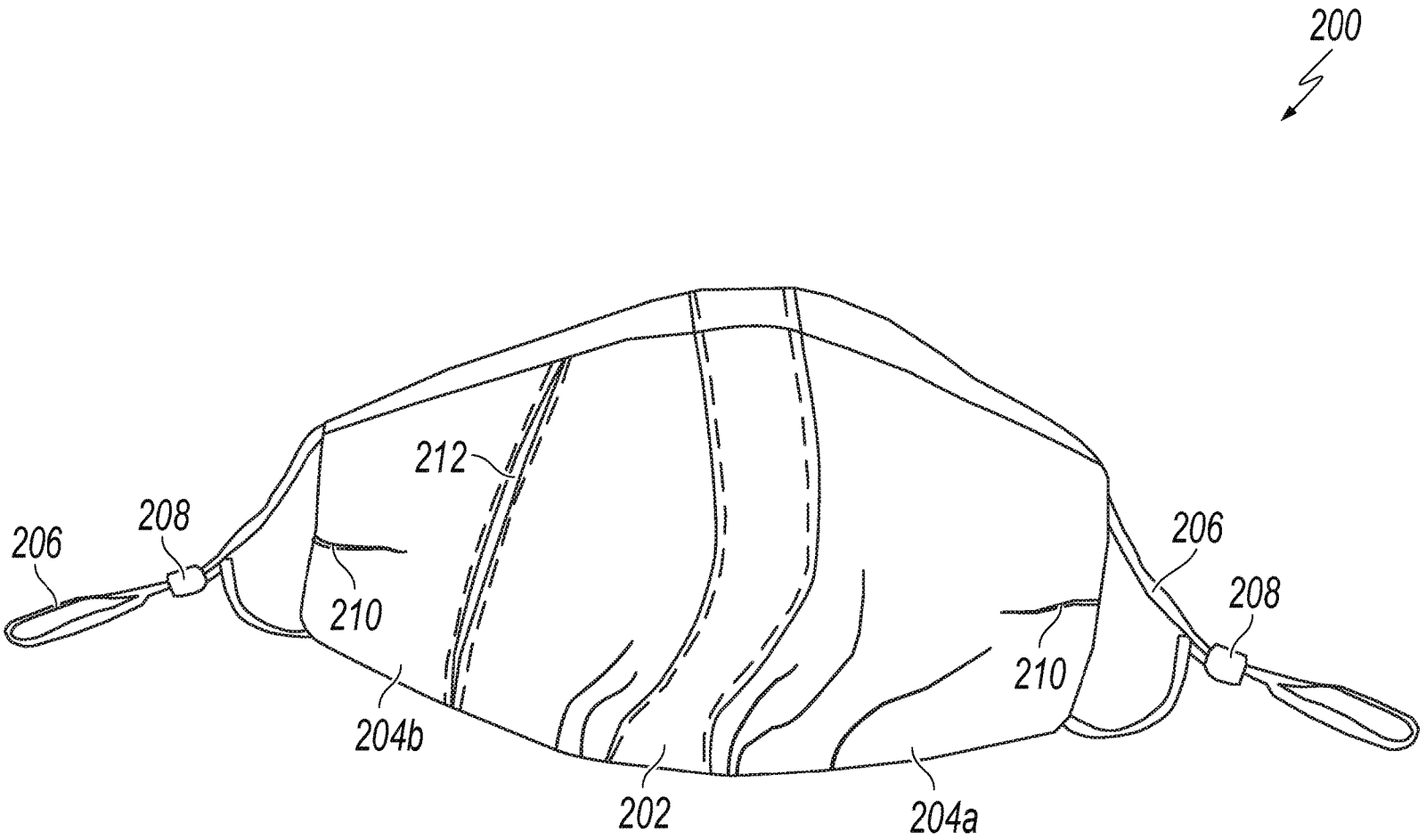
FIG. 2 is a diagram of another example face mask, according to an implementation.

FIG. 2 illustrates another example face mask 200 having a breathable space and a filter pocket, according to an implementation. The face mask 200 comprises a center sheet (not shown), two side sheets (not shown), a back center sheet 202, two back side sheets 204*a*, 204*b*, and two fixing parts 206. In some embodiments, the center sheet, the side sheet, and the fixing part 206 may be the center sheet 102, the side sheet 104*a*, 104*b*, and the fixing part 106 disclosed in FIG. 1. In one embodiment, the center sheet and the two side sheets of the face mask 200 can be an integrated fabric or one single sheet. In one embodiment, the center sheet and the two side sheets of the face mask 200 may be an outer layer of the face mask 200.

The back center sheet 202 is a stripe-like fabric. In one embodiment, the back center sheet 202 may be a nose bridge which is attached with the two back side sheets 204*a*, 204*b* vertically. In one embodiment, the back center sheet 202 is a rectangular fabric which comprises two opposite long sides and two opposite short sides. In one embodiment, a width of the short side of the back center sheet 202 may be one inch. In one embodiment, a length of the long side of the back center sheet 202 may be six inches. The back center sheet 202 is curvy along a longitudinal axis. For example, the curvy shape of the back center sheet 202 may be determined based on a user's face profile, in order to create an appropriate room to separate the user's nose and month from the face mask 200. In one embodiment, a length of the long side of the back center sheet 202 may be determined based on the user's face profile, e.g., a length from the user's nose to the user's chin, to ensure an efficient coverage of the user's nose and mouth. In one embodiment, the back center sheet 202 is shaped corresponding to the center sheet and also coupled to it.

The back side sheet 204*a*, 204*b* is a relatively flat fabric which comprises a first edge and a second edge. The first edge is opposite to the second edge, and a length of the first edge of the back side sheet 204*a*, 204*b* is corresponding to a length of the long side of the back center sheet 202, and the first edge of the back side sheet 204*a*, 204*b* is coupled to the long side of the back center sheet 202. In one embodiment, the back side sheet 204*a*, 204*b* is shaped corresponding to the side sheet of the face mask 200. In one embodiment, the first edge of the back side sheet 204*a*, 204*b* is sewed to the edge of the long side of the back center sheet 202. In one embodiment, a shape of the back side sheet 204*a*, 204*b* may be similar to a shape of the user's cheek. The back side sheet 204 comprises at least one dart 210 at the second edge, so that the shape of the back side sheet 204 may fit the user's cheek better. The two back side sheets 204*a*, 204*b* are coupled to the two long sides of the back center sheet 202 separately to form an inner layer of the face mask 200.

In one embodiment, the fixing part 206 may be an ear loop, a head tie, a strap, and any suitable element which can secure the body of the face mask 100 to the user's head.

In one embodiment, the back center sheet 202 coupled with the two back side sheets 204*a*, 204*b* is coupled to the center sheet coupled with the two side sheets to form the face mask 200, e.g., the outer layer of the face mask 200 is sewed together with the inner layer of the face mask 200 to form a two-layered face mask. In one embodiment, the fixing part 206 is coupled to the face mask 200. For example, the fixing part 206 can be coupled to either the outer layer of the face mask 200 or the inner layer of the face mask 200, in some cases, the fixing part 206 can be coupled to both of the outer layer and the inner layer of the face mask 200. Furthermore, the fixing part 206 may comprise a toggle 208 which can adjust a length of the fixing part 206. For example, when the fixing part 206 is a strap, the toggle 208 can be attached to the middle of the strap, so a position of the toggle 208 on the strap can be adjusted to reach an appropriate length to fit the user better.

In one embodiment, at least one of the back side sheet comprises an opening 212.

The opening 212 forms a pocket/space within the face mask 200, i.e., the opening 212 allows the user to access to the space formed between the center sheet, the two side sheets, the back center sheet, and the two back side sheets of the face mask 200. For example, the user may insert or replace a filter via the opening 212 into the face mask 200 as needed.

Figure 3A:
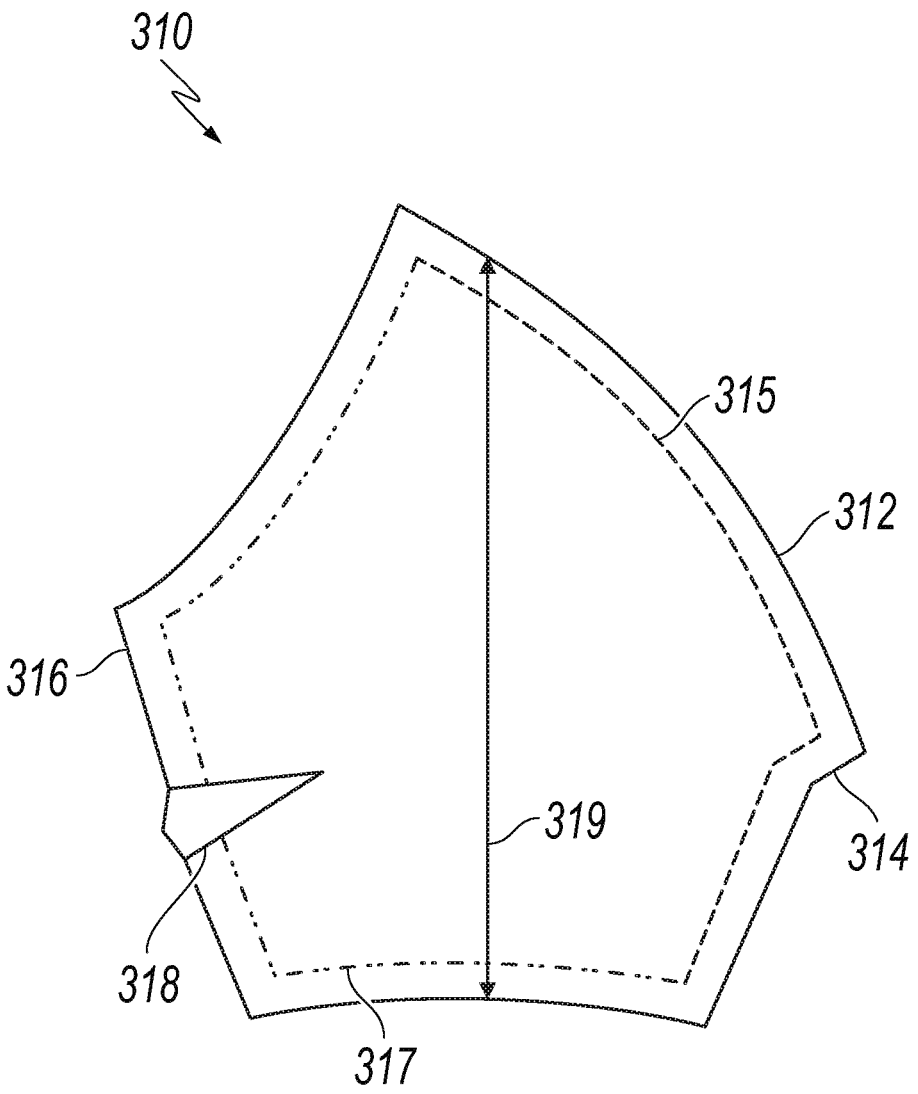
FIG. 3A to FIG. 3D are diagrams showing parts of an example face mask, according to an implementation.

FIGS. 3A to 3D illustrates parts of an example face mask, according to an implementation. The face mask comprises two side sheets 310, a center sheet 320, and two back side sheets. FIG. 3A illustrates the side sheet 310 of the face mask, e.g., the side sheet 104*a*, 104*b* described in FIGS. 1 and 2. The side sheet 310 comprises a first edge 312 and a second edge 316. The first edge 312 is opposite to the second edge 316. In one embodiment, a length of the first edge 312 may be longer than a length of the second edge 316, where the length of the first edge 312 may be designed to accommodate a user's nose and mouth and the length of the second edge 316 may be designed to fit the size of the user's cheek. In one embodiment, a shape of the side sheet 310 may be similar to a shape of the user's cheek. The side sheet 310 comprises at least one dart 318 at the second edge 316, so that the shape of the side sheet 310 may fit the user's cheek better. In one embodiment, the first edge 312 comprises a notch 314 which creates an extra space for the user's nose when connected to the center sheet 320. The first edge 312 comprises a first seam line 315 to be connected to the center sheet 320. Furthermore, the side sheet 310 comprises a second seam line 317 to loop around the side sheet 310 to be connected with the back side sheet and a fixing part (not shown). In one embodiment, the side sheet 310 comprises a grain line 319 to indicate a weave of the fabric of the side sheet 310 which means the direction of the threads running, such that the user may adjust how to cut or seam the side sheet 310 if needed. The two side sheets 310 are coupled to two long sides of the center sheet 102 separately to form a front body of the face mask.

Figure 3B:
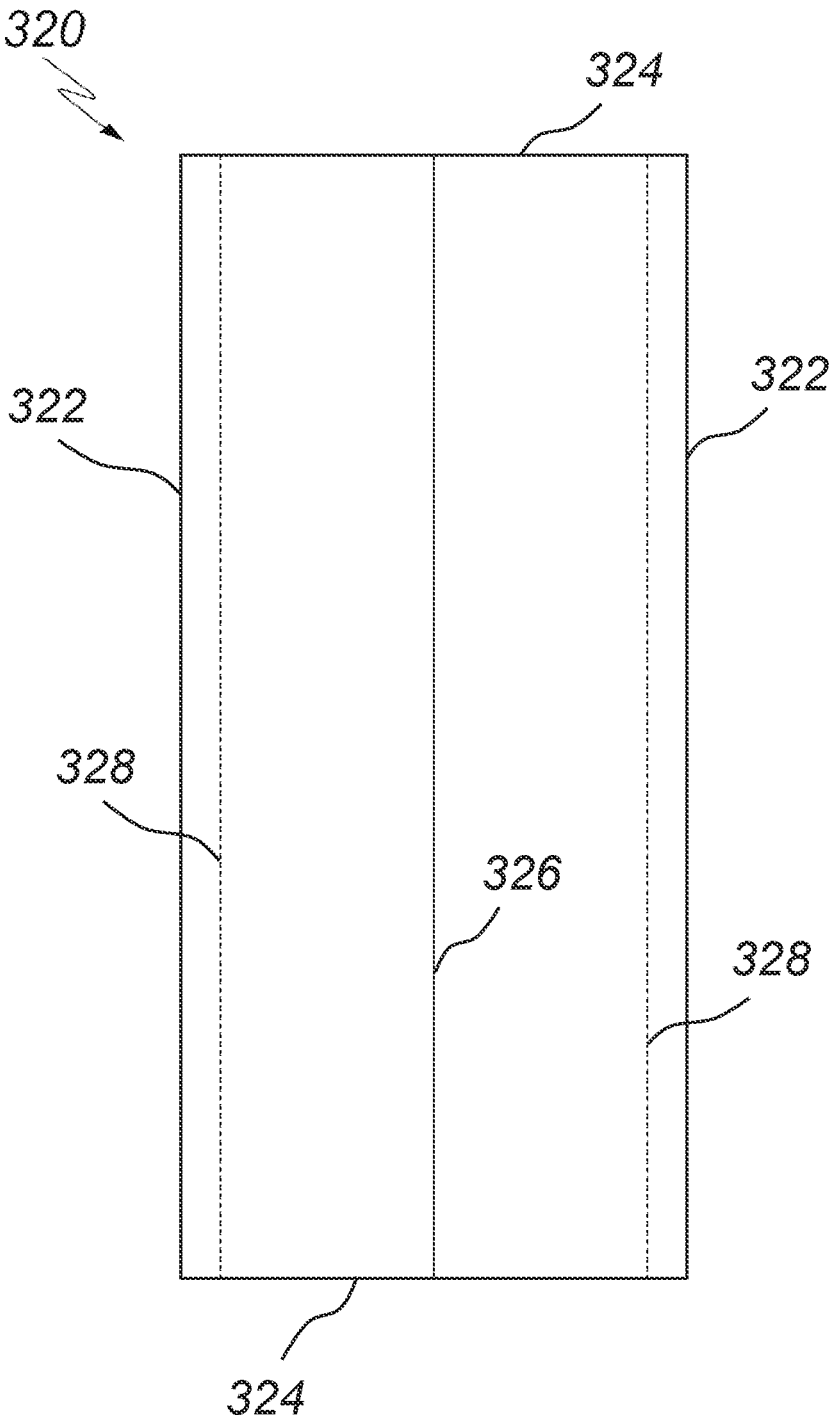

FIG. 3B illustrates the center sheet 320 of the face mask, e.g., the center sheet 102, 202 described in FIGS. 1 and 2. The center sheet 320 may be a rectangular fabric which comprises two opposite long sides 322 and two opposite short sides 324. In one embodiment, the center sheet 320 may be a nose bridge which is attached with the two side sheets 310 via the long sides 322 separately to support a curved shape of the center sheet 220. In one embodiment, the long side 322 of the center sheet 320 comprises a seam line 328 which is used to connect the first seam line 315 of the side sheet 310 to form the front body of the face mask.

Figure 3C:
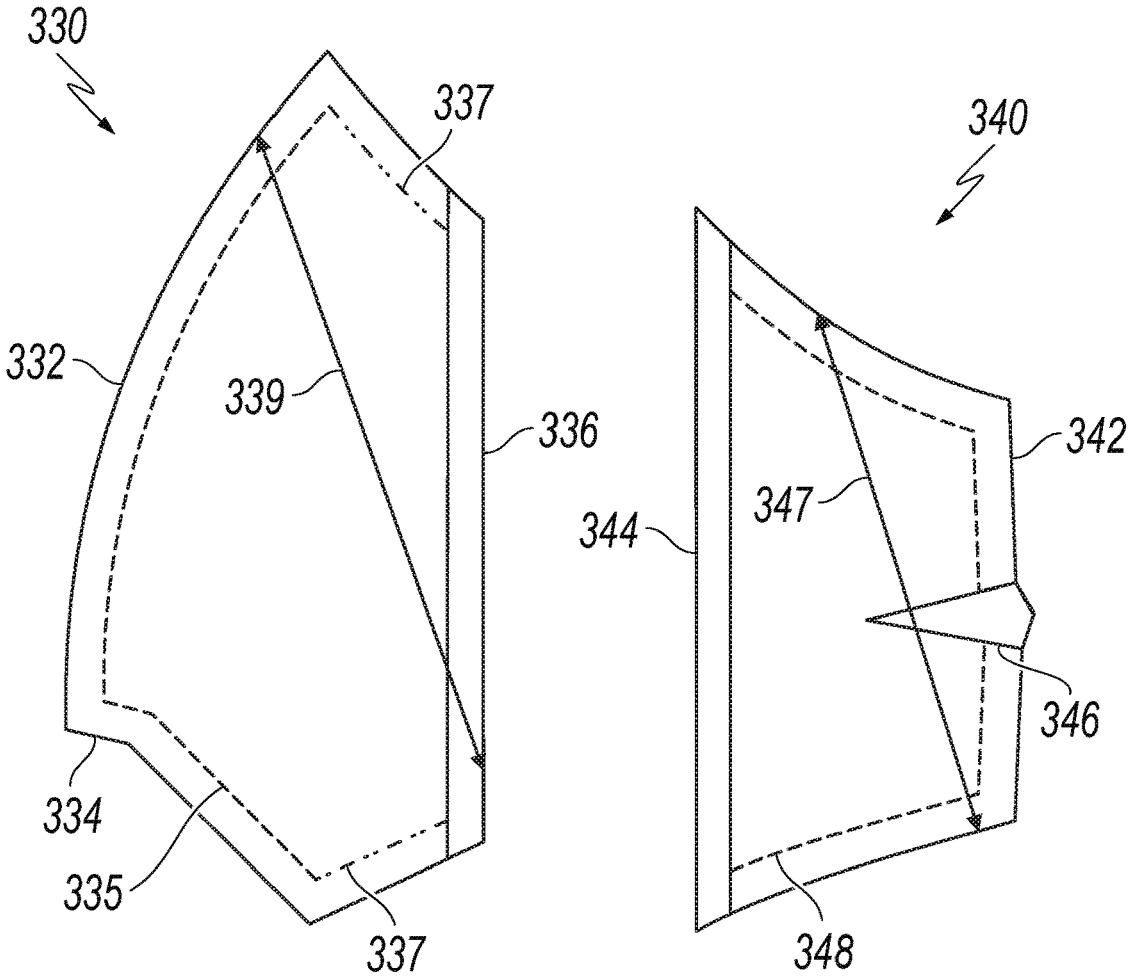

FIG. 3C illustrates the back side sheet of the face mask, e.g., the back side sheet described in FIG. 2. In one embodiment, a shape the back side sheet may be equivalent or similar to the side sheet 310. In one embodiment, the back side sheet may comprise a major piece 330 and a minor piece 340 to form an inlet of the face mask. The major piece 330 comprises a first edge 332 and a second edge 336. The first edge 332 is opposite to the second edge 336. In one embodiment, a length of the first edge 332 may be equivalent to the length of the first edge 312 of the side sheet 310. In one embodiment, the first edge 332 comprises a notch 334 which creates an extra space for the user's nose when connected to the center sheet 320 or to the other back side sheet. The first edge 332 comprises a first seam line 335 to be connected to the center sheet 320 or to the other back side sheet. Furthermore, the major piece 330 comprises a second seam line 337 between the first edge 332 and the second edge 336 to be connected with the side sheet 310. The minor piece 340 comprises a first edge 344 and a second edge 342. The minor piece 340 comprises at least one dart 346 at the second edge 342, so that the shape of the minor piece 340 may fit the user's cheek better. Furthermore, the minor piece 340 may comprise the fixing part at the second edge 342 with the side sheet 310. In one embodiment, the minor piece 340 comprises a seam line 348 which is around the edge of the minor piece 340 except for the first edge 344. The seam line 348 is used to connect with the side sheet 310. The second edge 336 of the major piece 330 and the first edge 344 of the minor piece 340 are left open to form the inlet of the face mask. In one embodiment, the major piece 330 and the minor piece 340 comprise grain lines 339, 347 to indicate a weave of the fabric which means the direction of the threads running, such that the user may adjust how to cut or seam the major piece 330 and the minor piece 340 if needed.

Figure 3D:
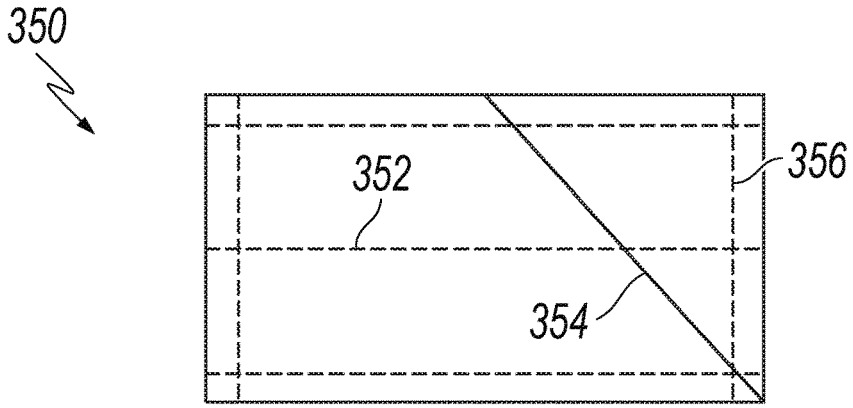

FIG. 3D illustrates an additional sack 350 for the face mask. The sack 350 is a rectangular fabric which comprises a folding line 352 and a seam line 356. A nose wire can be placed along the folding line 352 and sealed within the sack 350 by folding the sack 350 and seaming along the seam line 356 to enclose the sack 350. Furthermore, the sack 350 with the nose wire can be combined with the face mask, normally along the top edge of the face mask horizontally, to provide additional support to form the breathable space of the face mask. In one embodiment, the sack 350 comprises a grain line 354 to indicate a weave of the fabric which means the direction of the threads running, such that the user may adjust how to cut or seam the sack 350 if needed.

For each of the fabric parts in the face masks disclosed in the present application, e.g., center sheet, side sheet, back center sheet, and back side sheet, a sewing preference is to leave a ¼ inch seam allowance for each joint, and a grain line or a fabric bias is preferably in a diagonal direction or a vertical direction to each of the fabric parts of the face mask. Furthermore, the face mask disclosed in the present application may comprise a nose wire sack to accommodate a nose wire. The nose wire sack is a rectangular fabric in the center of the face mask. In one embodiment, the nose wire sack is formed by placing the nose wire on the fabric, folding the fabric along the longitudinal direction to keep the nose wire in a sack, and sewing the fabric to seal the sack with a ¼ inch seam along the edge of the fabric.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking and parallel processing may be advantageous.

Moreover, the separation and/or integration of various system modules and components in the implementations described above should not be understood as requiring such separation and/or integration in all implementations, and it should be understood that the described program components and systems can generally be integrated together in a single software product or packaged into multiple software products.

Accordingly, the above description of example implementations does not define or constrain this disclosure. Other changes, substitutions, and alterations are also possible without departing from the spirit and scope of this disclosure.

What is claimed is:

1. A face mask having curved edges and edge darts that together form a breathable space that leaves space between the mask and a mouth of the person when wearing the mask, the face mask comprising:

an outer layer comprising:

a front center sheet having two opposite long sides comprising a first long side and a second long side;

a first front side sheet having a first curved edge and a first short edge opposite to the first curved edge, wherein the first curved edge is longer than the first short edge;

a second front side sheet having a second curved edge and a second short edge opposite to the second curved edge, wherein the second curved edge is longer than the second short edge;

wherein the first curved edge of the first front side sheet is coupled to the first long side of the center sheet, wherein the second curved edge of the second front side sheet is coupled to the second long side of the center sheet, wherein the first short edge of the first front side sheet has a first edge dart and the second short edge of the second front side sheet has a second edge dart;

two fixing parts comprising a first fixing part and a second fixing part, wherein the first fixing part is coupled to the first short edge of the first front side sheet, and wherein the second fixing part is coupled to the second short edge of the second front side sheet;

an inner layer comprising:

a back center sheet;

a first back side sheet comprising a major piece and a minor piece, the major piece and the minor piece being two separate pieces connected to the first front side sheet, wherein the major piece comprises a third curved edge and a first pocket edge opposite to the third curved edge, wherein the minor piece comprises a first edge and a second edge, wherein the second edge comprises a third edge dart; and a second back side sheet comprising a fourth curved edge and a third short edge opposite to the fourth curved edge, wherein the third short edge comprises a fourth edge dart, wherein the third curved edge of the major piece and the fourth curved edge of the second back side sheet are connected to two edges of the back center sheet, wherein the outer layer and the inner layer when coupled together form a pocket having an opening between the pocket edge of the major piece and the first edge of the minor piece of the first back side sheet, wherein the first edge dart, the second edge dart, the third edge dart, and the fourth edge dart in conjunction with the first curved edge and the second curved edge of the front side sheets being attached to straight edges of the front center sheet, and the third curved edge and the fourth curved edge of the back side sheets being attached to straight edges of the back center sheet, cause the mask to form a breathable space that leaves space between the mask and a mouth of the person when wearing the mask while also providing coverage of the user's mouth when wearing the mask.

2. The face mask of claim 1, wherein the front center sheet is curvy along a longitudinal axis of the center sheet.

3. The face mask of claim 1, wherein the third curved edge of the major piece piece comprises a notch configured to create a space for a user's nose.

4. The face mask of claim 1, wherein the back center sheet and the two back side sheets form a back sheet, wherein the back sheet is shaped corresponding to a shape of the front center sheet coupled with the first front side sheet and the second front side sheet, and wherein the back sheet is coupled to the front center sheet, the first front side sheet and the second front side sheet.

5. The face mask of claim 4, wherein the pocket is between the front center sheet, the first front side sheet and the second front side sheet, and the back sheet.

6. The face mask of claim 1, wherein the first fixing part is a strap which is coupled to two endpoints of the first short edge of the first front side sheet to form a loop.

7. The face mask of claim 6, wherein the strap comprises a toggle which adjusts a length of the strap.

8. The face mask of claim 1, wherein:

the back center sheet is shaped corresponding to the front center sheet; and the two back side sheets are shaped corresponding to the two front side sheets, wherein the two back side sheets are coupled to the back center sheet, the front center sheet, and the two front side sheets to form a two-layered face mask.

9. The face mask of claim 8, wherein the back center sheet is curvy along a longitudinal axis of the back center sheet.

* * * * *